US007536759B2

(12) United States Patent
Hoshino

(10) Patent No.: US 7,536,759 B2
(45) Date of Patent: May 26, 2009

(54) CLASP AND METHOD FOR ASSEMBLING THE SAME

(76) Inventor: Masahiro Hoshino, 701, 14-12, Komagome 1-chome, Toshima-ku, Tokyo (JP)

( * ) Notice: Subject to any disclaimer, the term of this patent is extended or adjusted under 35 U.S.C. 154(b) by 227 days.

(21) Appl. No.: 11/541,689

(22) Filed: Oct. 3, 2006

(65) Prior Publication Data

US 2007/0113386 A1 May 24, 2007

(30) Foreign Application Priority Data

Nov. 21, 2005 (JP) ..... 2005-336007

(51) Int. Cl.

| | |
|---|---|
| ***A44B 11/00*** | (2006.01) |
| ***A44C 5/18*** | (2006.01) |
| ***A44C 25/00*** | (2006.01) |
| ***A44C 11/02*** | (2006.01) |

(52) U.S. Cl. ..... 24/633; 24/334; 63/3.1; 63/3.2

(58) Field of Classification Search ..... 24/334
See application file for complete search history.

(56) References Cited

U.S. PATENT DOCUMENTS 4,319,384 A * 3/1982 Horne ..... 24/599.8
4,613,180 A * 9/1986 Pope ..... 294/82.21
5,586,374 A * 12/1996 Nishida ..... 63/3.1
5,899,512 A * 5/1999 Wiklund ..... 294/82.19
6,349,568 B1 * 2/2002 Ito ..... 63/3
6,484,376 B1 * 11/2002 Khatchadourian et al. .... 24/658
2004/0194503 A1 * 10/2004 Schnitman ..... 63/3.2
2005/0242602 A1 * 11/2005 Protesto ..... 294/82.21

* cited by examiner

*Primary Examiner*—Robert J Sandy
(74) *Attorney, Agent, or Firm*—Berenato, White & Stavish, LLC.

(57) ABSTRACT

A clasp including a base connected to at least one end of looping member which has an upper opening at an upper side thereof and which has a front opening at a front side thereof; an arm which is supported by the edge of the base in a rotatable manner, which has a nail portion at a rear end thereof; and which makes up a loop by closing the arm; a push button embedded within the upper opening of the base and communicated with the nail portion of the arm; a first spring which applies a resilient force to the push button in the direction that the push button is projecting outwardly; and a second spring which applies a resilient force to the arm in the direction of opening the arm.

7 Claims, 9 Drawing Sheets

CLASP AND METHOD FOR ASSEMBLING THE SAME

BACKGROUND ARTS

1. Field of the Invention

The present invention relates to a clasp for accessories such as necklace, bracelet, anklet, and pendant, and a method for producing the same. More specifically, the present invention relates to a clasp which makes it possible to make a wide variety of arrangement and a method for producing the same.

2. Description of Related Arts

Referring to FIG. 11A and FIG. 11B, it has hitherto been known that a necklace 40 comprising lined beads and a clasp as a fastener, making up a body of decorative portions. FIG. 11 shows a conventional clasp, where FIG. 11A is a total view of the conventional clasp, and FIG. 11B is an enlarged perspective view showing a rear side of the connecting portion of the conventional clasp. As shown in FIG. 11B, the necklace 40 is composed of a plurality of lined beads 41 such as pearl beads, through which a thread 42 is pierced, the thread 42, one end of which is terminated by a fastening ring 46, a plurality of spacers 43, and a clasp 44 having a decoration, a fastener 45 provided on a rear surface of the and having a hook receiving portion 45*a* and a hooking portion 45*b* formed thereon (for example, see Japanese Patent Laid-Open No. 2005-296523, typically FIG. 3 and FIG. 4 thereof).

However, in such a connecting method in a hooking manner as described above, since the clasp itself is small, it is difficult to fasten a clasp utilizing both hands of a user, and for example, at the time of connection, nail portions of both fingertips are interfered with each other, leading to a possibility that nail portion is injured. In addition, there is disadvantage that when being put off, if there is somewhat slanting of the direction in the pulling direction, the connection is difficult to be released. Also, due to aging, a person whose fingertips only can move slowly, typically, the aged person can attach and detach the hooking type clasp only with difficulty.

An object of the present invention is to provide a clasp which can be handled with ease even when it is small and for person whose fingertips move slowly, and which has reduced possibility to injuring fingertip.

SUMMARY OF THE INVENTION

According to the present invention, which attain the object described above, a clasp is provided which comprises:

a base connected to at least one end of looping member which has an upper opening at an upper side thereof and which has a front opening at a front side thereof;

an arm which is supported by the edge of said base in a rotatable manner, which has a nail portion at a rear end thereof, and which makes up a loop by closing the arm;

a push button embedded within the upper opening of the base and communicated with said nail portion of the arm;

a first spring which applies a resilient force to said push button in the direction that the push button is projecting outwardly; and a second spring which applies a resilient force to said arm in the direction of opening the arm.

In the clasp of the invention, a cavity is preferably provided on an inner surface of the base at a portion overlooking from the front opening.

In the clasp of the invention, the push button has a upper opening provided at an upper side thereof, a back side opening provided at the back side thereof, and a step provided at a front side thereof, and one side of the upper opening is making up a communicating portion.

In the clasp of the invention just mentioned, it is assembled by (a) a step for inserting the first spring into the push button from the back side opening thereof;

(b) a step for inserting the push button having the first spring inserted therein into the base from the upper opening thereof, allowing one end of the first spring for falling into the cavity of the base to thereby cover the front side opening of the base with the push button in the state of applying the resilient force of the first spring to the front opening; and (c) a step for inserting a pin which is connected to the edge of the base into one end of the arm via the second spring to support the arm by the base in a rotable manner.

According to the second aspect of the present invention, there is provided a clasp which comprises:

a base connected to at least one end of looping member which has an upper opening at an upper side thereof and which has a front opening at a front side thereof;

an arm which is supported by the edge of said base in a rotatable manner, which has a nail portion at a rear end thereof, and which makes up a loop by closing the arm;

a push button projected on the upper opening of the base and having a communication hole suppurated by a central portion of the base and communicated with said nail portion of the arm;

a third spring which applies a resilient force to said push button in the direction that the push button is projecting outwardly; and a fourth spring which applies a resilient force to said arm in the direction of opening the arm.

According to the third aspect of the present invention, there is provided a method for assembling a clasp comprising a base connected to at least one end of looping member which has an upper opening at an upper side thereof and which has a front opening at a front side thereof; an arm which is supported by the edge of said base in a rotatable manner, which has a nail portion at a rear end thereof, and which makes up a loop by closing the arm; a push button embedded within the upper opening of the base and communicated with said nail portion of the arm; a first spring which applies a resilient force to said push button in the direction that the push button is projecting outwardly; and a second spring which applies a resilient force to said arm in the direction of opening the arm, wherein the push button has a upper opening provided at an upper side thereof, a back side opening provided at the back side thereof, and a step provided at a front side thereof, and one side of the upper opening is making up a communicating portion, which comprises:

(a) a step for inserting the first spring into the push button from the back side opening thereof;

(b) a step for inserting the push button having the first spring inserted therein into the base from the upper opening thereof, allowing one end of the first spring for falling into the cavity of the base to thereby cover the front side opening of the base with the push button in the state of applying the resilient force of the first spring to the front opening; and (c) a step for inserting a pin which is connected to the edge of the base into one end of the arm via the second spring to support the arm by the base in a rotable manner.

According to the fourth aspect of the present invention, there are provided accessories having the clasp of the present invention, such as necklace, bracelet, and anklet.

BRIEF DESCRIPTION OF THE DRAWINGS

FIG. 1 shows how to use the clasp according to the present invention, wherein

FIG. 2 shows a first embodiment of the present invention, wherein

FIG. 6 shows a push button wherein FIG. 6A shows a push button shown in FIG. 5, wherein FIG. 6A is a perspective view shown from backside.

FIG. 7 is a longitudinal sectional view of FIG. 5 along with line F-F, wherein

FIG. 8 shows a second of the present invention, wherein

FIG. 9 shows a drawing enlarging the perspective view of FIG. 8, wherein

FIG. 10 is a longitudinal sectional view of FIG. 9A, wherein

DETAILED DESCRIPTION OF THE INVENTION

Referring to the attached figures, an accessory according to the present invention will now be described.

Figure 1A:
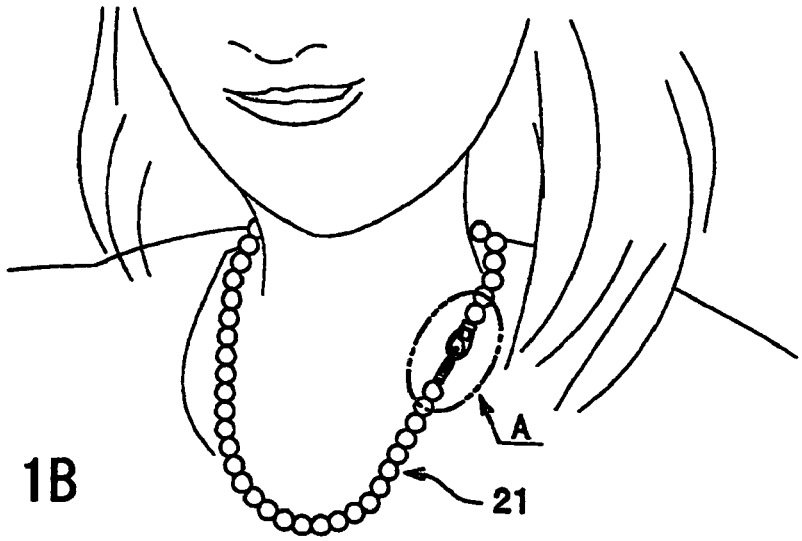
FIG. 1A is a perspective view of an accessory comprising looped member composed of lined beads.
Figure 1B:
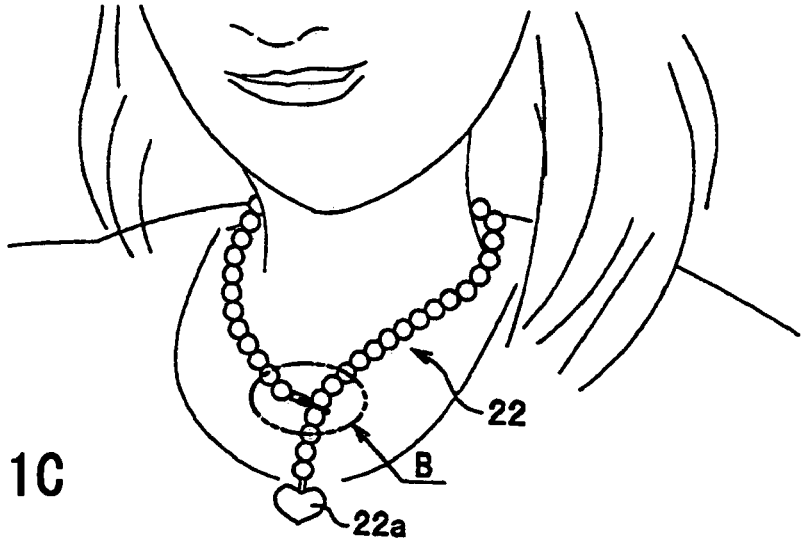
FIG. 1B is a perspective view of the accessory in which a loop of the lined beads is formed by the clasp.
Figure 1C:
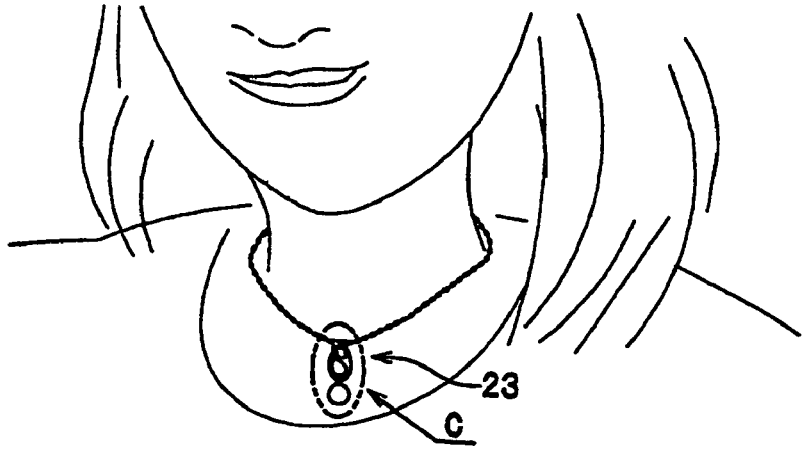
FIG. 1C is a perspective view of a pendant utilizing the clasp of the present invention for pendant.

FIG. 1 shows how to use the clasp according to the present invention, wherein FIG. 1A is a perspective view of an accessory comprising looped member composed of lined beads, FIG. 1B is a perspective view of the accessory in which a loop of the lined beads is formed by the clasp, and FIG. 1C is a perspective view of a pendant utilizing the clasp of the present invention for pendant.

FIG. 1A shows an embodiment of the clasp 10 according to the present invention used in a necklace. Other than the necklace, the clasp of the present invention may be used in bracelet and anklet.

FIG. 1B shows an embodiment of the clasp 10 according to the present invention that the looping member of the necklace is voluntary adjust according to the neck size of the user to form a loop.

FIG. 1C shows an embodiment of the clasp 10 according to the present invention used as the accessory of the pendant.

FIRST EMBODIMENT

Figure 2A:
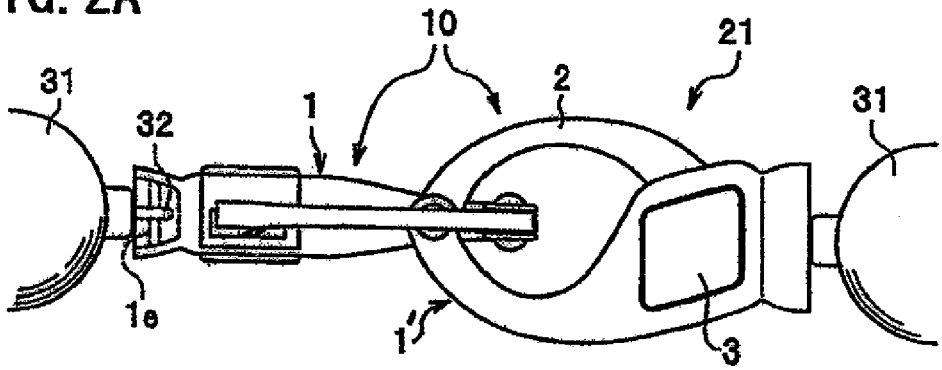
FIG. 2A is an enlarged drawing of portion A of FIG. 1A.
Figure 2B:
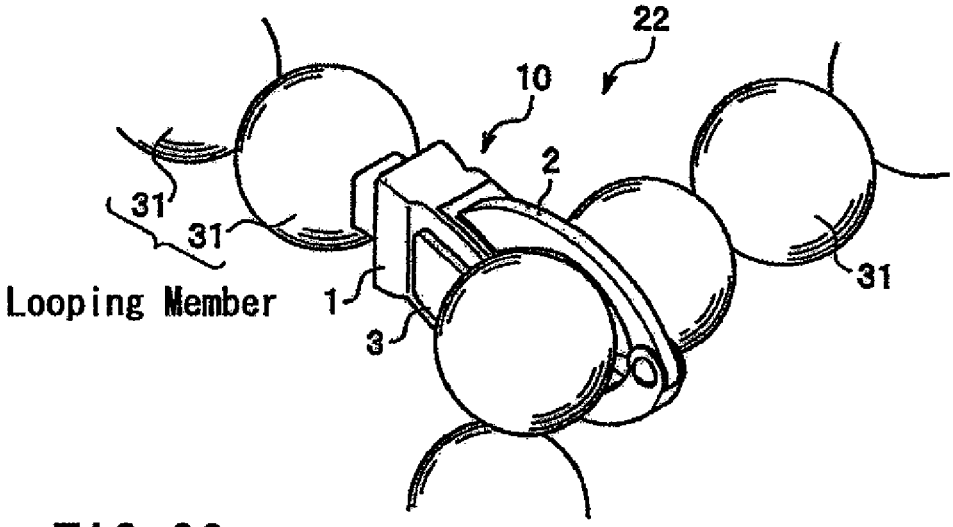
FIG. 2B is an enlarged drawing of portion A of FIG. 1B.
Figure 2C:
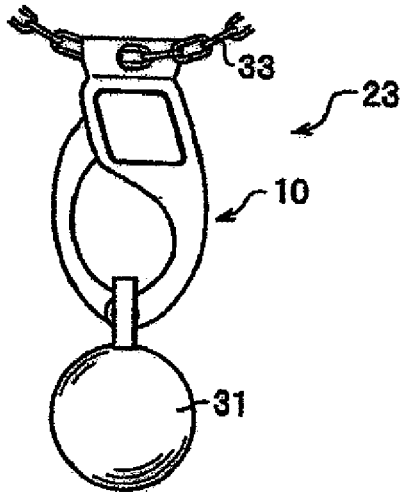
FIG. 2C is an enlarged drawing of portion A of FIG. 1C.

FIG. 2 shows a first embodiment of the present invention, wherein FIG. 2A is an enlarged drawing of portion A of FIG. 1A, FIG. 2B is an enlarged drawing of portion A of FIG. 1B, and FIG. 2C is an enlarged drawing of portion A of FIG. 1C, As shown in FIG. 2A, a plurality of pearls (31) are connected by a thread 32 to form a string member (series of lined pearls). The clap 10 is connected to both ends of the thread 32. The thread 32 is wound around a communication pin 1*e* formed at a rear side end of the base 1, 1' to communicate the claps 10 with each other making up a loop of the necklace.

As shown in FIG. 2B, the necklace 21 comprises a thread 32, a clasp 10 connected to one end of the thread 32, and a pendant 22*a* (see FIG. 1B) connected to the other end of the thread 32. The clasp 10 is communicated between two pearls of the series of the lined pearls so as to arrange the optimum size of the loop.

As shown in FIG. 2C, the pendant 23 is composed of a chain 22 made of noble metal such as gold, platinum, and silver inserted into a hole provided on a rear end of the clasp 10, and a pearl connected to the clasp 10. The clasp 10 according to the present invention can be made use of the pendant as described above.

Figure 3:
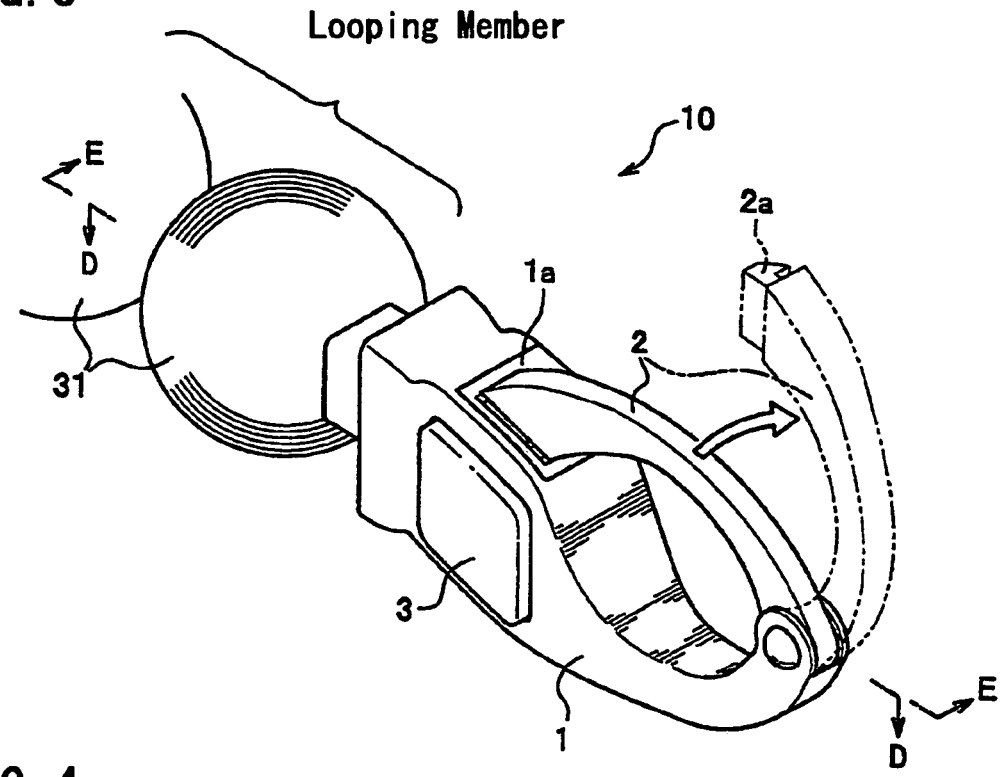
FIG. 3 is a further enlarged drawing of FIG. 2B.

FIG. 3 is a further enlarged drawing of FIG. 2B. As shown in FIG. 3, the clasp 10 of the present invention is composed of a base 1 connected to either or both ends of looping member (string) which has an upper opening at an upper side thereof and which has a front opening at a front side thereof; an arm 2 which is supported by the edge of the base 1 in a rotatable manner, which has a nail portion 2*a* at a rear end thereof, and which makes up a loop by closing the arm 2; a push button 3 embedded within the upper opening 1*a* of the base 1 and communicated with the nail portion 2*a*; a first spring 4 which applies a resilient force to said push button 3 in the direction that the push button 3 is projecting outwardly; and a second spring 5 which applies a resilient force to the arm 2 in the direction of opening the arm 2. The clasp 10 of the present invention is connected to a looping member (string) comprising the a series of lined pearls 31, 31, . . . . An upper opening 1*a* is formed on the upper side of the base 1 of the clasp 10, and a push button 3 is placed on the front side of the base 1. By pushing the push button 2, the communication portion 3*c* (see FIG. 6) is moved and is apart from the nail portion 2*a* of the edge of the arm 2 so that the arm 2 is automatically released by means of the resilient force of the second spring 5. The size of the clasp is typically within 15×8×5 mm, but a clasp having a size larger than 15×8×5 mm is within the scope of the present invention. The clasp 10 of the present invention is usually plated by gold, rhodium or similar metal or metal alloy. The thread 32 may be made of a material having a sufficient strength such as wire, silk, and nylon.

Figure 4:
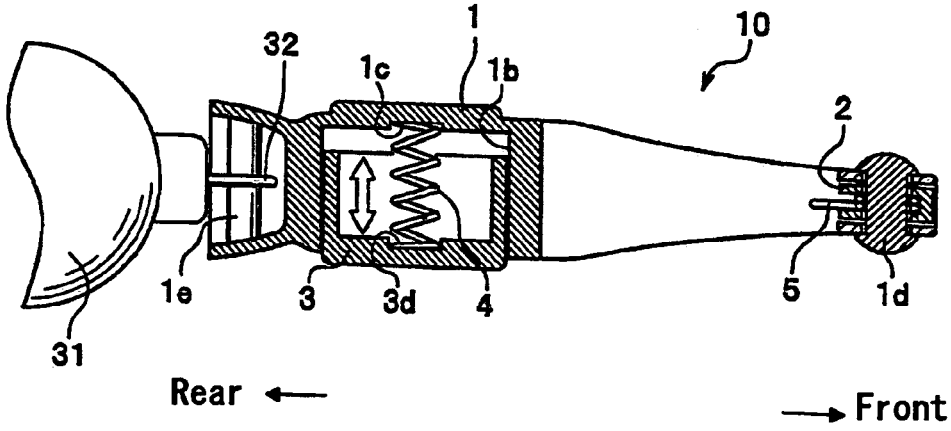
FIG. 4 is a cross sectional view of FIG. 3 along with line D-D.

FIG. 4 is a cross sectional view of FIG. 3 along with line D-D. As shown in FIG. 4, one end of the thread 32 making up the looping member together with the lined purls 31 is wound around and connected to the communication pin 1*e* provided at the rear end (left in this figure) of the base 1, whereby the base 1 of the clasp 10 is connected. Within the inner side of the back surface of the base 1, a cavity 1*c* corresponding to the size (diameter) of the coil spring 4, which is the first spring, are provided. The push button 3 to which the resilient force is applied by the coil spring 4 is placed.

Figure 5:
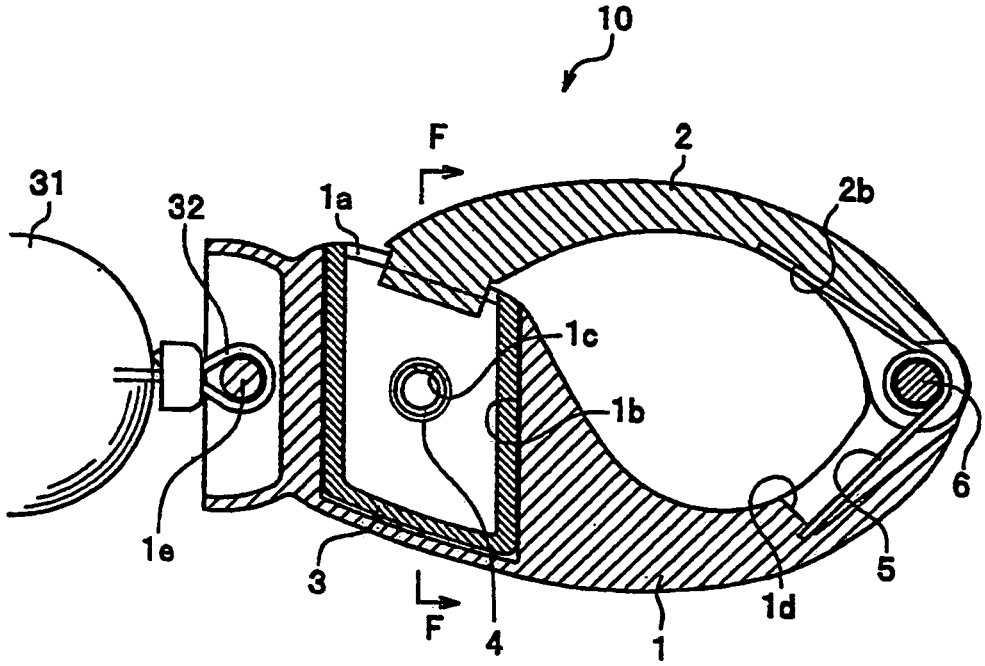
FIG. 5 is a longitudinal sectional view of FIG. 3 along with line E-E.

FIG. 5 is a longitudinal sectional view of FIG. 3 along with line E-E. As shown in FIG. 5, the upper opening 1*a* is provided on the upper side of the base 1 and the front side opening 1*b* is provided on the front side of the base 1. The arm 2 is rotatably supported at the one end of the base 1 (right in this figure), and the other end of the arm 2 (left in this figure) has a nail portion 2*a*. The base 1 and the arm 2 make up a ring by closing the arm 2 against the resilient force of the second spring. The base 1 and the arm 2 are supported in a rotatable manner by means of a pin 6. Groove portions 1*d* and 2*b* are formed within the inner circumferences of the base 1 and the arm 2, respectively, and a torsion spring 5 which is the second spring is fitted to these groove portions 1*d* and 2*b*. The push button 3 to which the resilient force is always applied in the direction of opening the push button 3 is pushed to thereby release and separate the attachment to the edge portion of the arm 2, automatically releasing the arm 2.

Figure 6A:
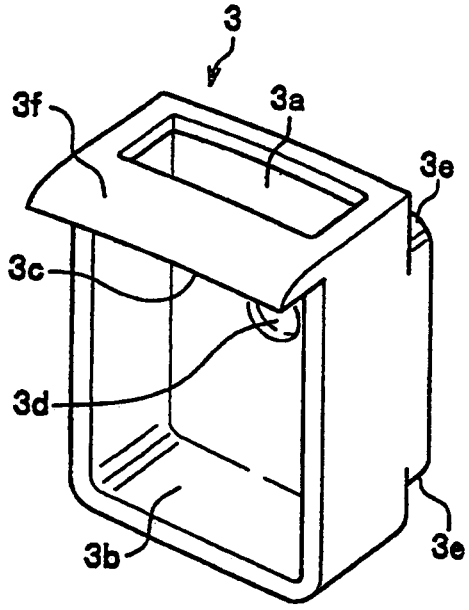
Figure 6B:
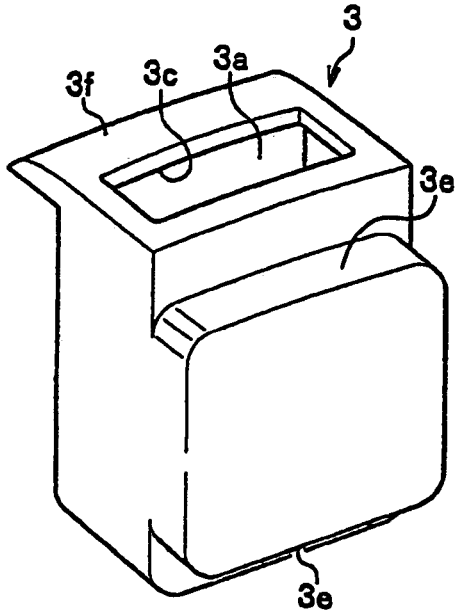
FIG. 6B is a perspective view shown from front side.

FIG. 6 shows a push button wherein FIG. 6A shows a push button shown in FIG. 5, wherein FIG. 6A is a perspective view shown from backside, and FIG. 6B is a perspective view shown from front side. As shown in FIG. 6B, viewing from the front, the push button 3 has a diamond sharp, and an upper opening 3*a*and an extended eaves 3*f* are provided on the upper side thereof. A communication portion 3*c* is provided on a line of the upper opening 3*a* at the side of the eaves 3*f*. As shown in FIG. 6A, the backside opening 3*b* is provided on the backside, and the cavity 3*d* for aligning the position of the coil spring serving as the first spring is provided. Furthermore, steps 3*e*, 3*e* are provided for preventing coming out the coil spring on both vertical ends so that the coil spring is not coming out of the front side opening 1*b* (see FIG. 5) of the base 1. By providing steps 3*e* and 3*e*, the communication and release can be ensured.

The operation of the clasp 10 will now be described. As shown in FIG. 1B, a user sends the accessory to her/his neck, and then fasten the arm 2 between the purl 32 and purl 32 as shown in double dot line of FIG. 3 (see FIG. 2B), and closes the arm to form a ring. Meanwhile, since the purl cannot pass through the ring, the position can be decided.

Figure 7A:
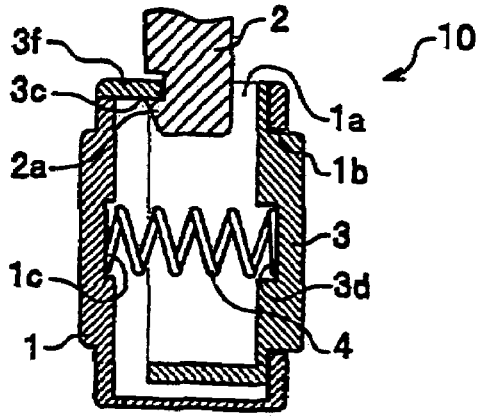
FIG. 7A shows a situation that the arm and the push button are communicated with each other.
Figure 7B:
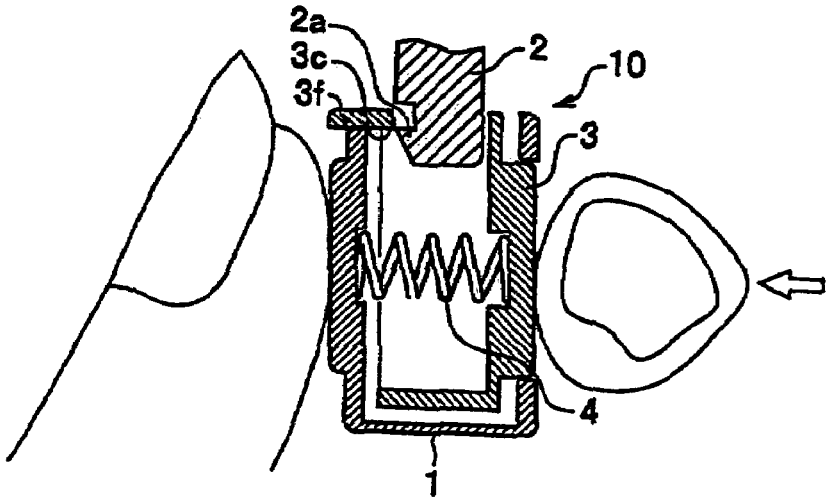
FIG. 7B shows a situation that the push button is pushed.
Figure 7C:
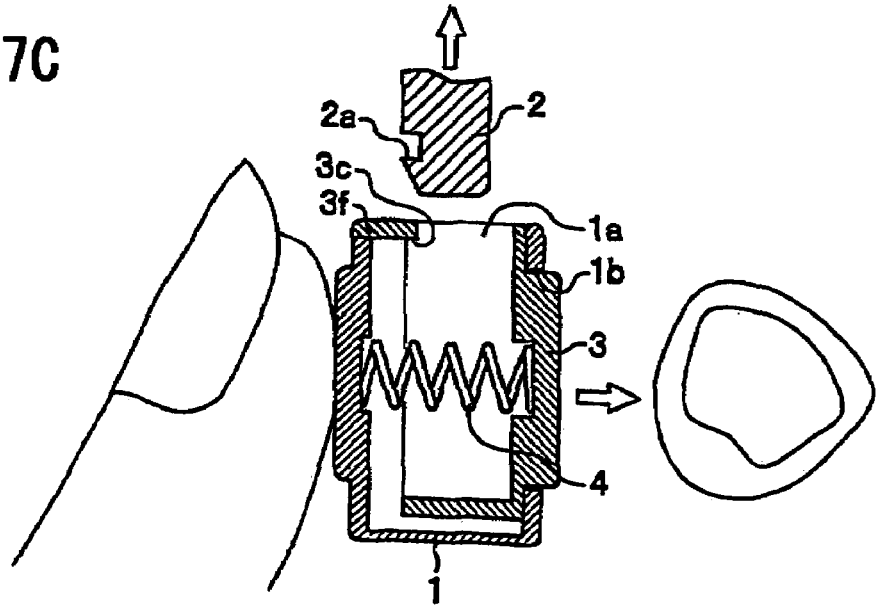
FIG. 7C shows a situation that the arm is apart from the communication part.

FIG. 7 is a longitudinal sectional view of FIG. 5 along with line F-F, wherein FIG. 7A shows a situation that the arm and the push button are communicated with each other, FIG. 7B shows a situation that the push button is pushed, and FIG. 7C shows a situation that the arm is apart from the communication part As shown in FIG. 7A, the nail portion 2*a* of the arm 2 is in the state where it is tightly communicated with the communication portion 3*c*, which is one side of the upper opening 3*a* of the push button 3.

As shown in FIG. 7B, when the user pushes the push button 3, the communication portion 3*c* of the push button 3 moves against the resilient force of the coil spring 4 in the left direction of this figure whereby the communication with the nail portion 2*a* of the arm 2 is released. Subsequently, as shown in FIG. 7C, the arm 2 is automatically apart from the communication portion 3*c* upwardly by means of the resilience force of the second spring to be in the state of the series of beads (purls) are released.

According to the clasp 10 of the first embodiment, since the clasp 10 can be operated by one hand (the thumb and forefinger), at the time of connection, nail portions of both fingertips are not interfered with each other, reducing a possibility that nail portion is injured. The clasp 10 of this embodiment can be attached and detached only by one hand and by one-touch operation.

Subsequently, the method for assembling the clasp 10 according to the present invention will now be described.

As shown in FIG. 7, the assembling method comprises the following steps:

A first step comprises inserting the first spring (coil spring) 4 into the push button 3 from the backside opening 3*b* of the push button 3.

A second step comprises inserting the push button 3 having the first spring 4 inserted therein into the base 1 from the upper opening 1*a* of the base, allowing one end of the first spring 4 for falling into the cavity 1*c* of the base 1 to thereby cover the front side opening 1*b* of the base 1 with the push button 3 in the state of applying the resilient force of the first spring 4 to the front opening 1*b*.

A third step comprises inserting a pin 6 which is connected to the edge of the base 1 into one end of the arm 2 via the second spring 5 to support the arm 2 by the base 1 in a rotable manner.

As a result, annealing utilizing fire force utilized in conventional method for assembling a clasp is not required in the present method and, thus, the clasp can be assembled in a much simpler manner within a reduced number of processes.

Furthermore, the clasp of the present invention can be operated only by one hand, there is no fear for injuring nail for example of woman, and the clasp according to the present invention can be easily handled for example by aged person.

SECOND EMBODIMENT

Figure 8A:
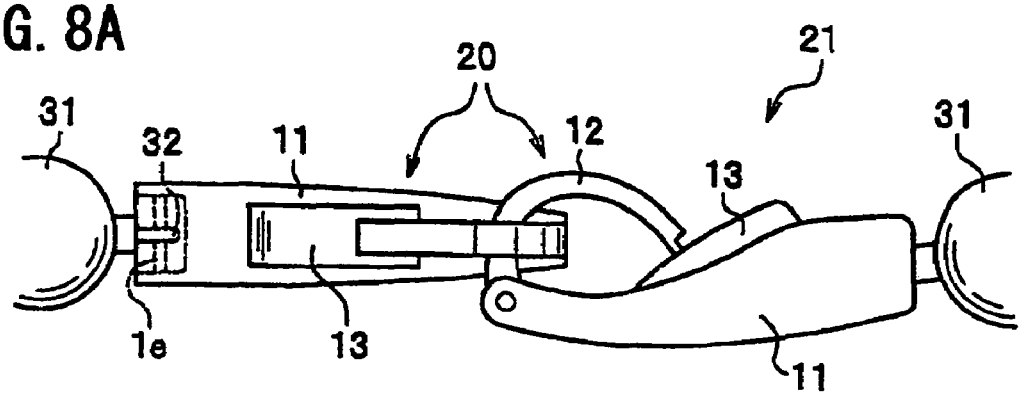
FIG. 8A is an enlarged drawing of portion A of FIG. 1A.
Figure 8B:
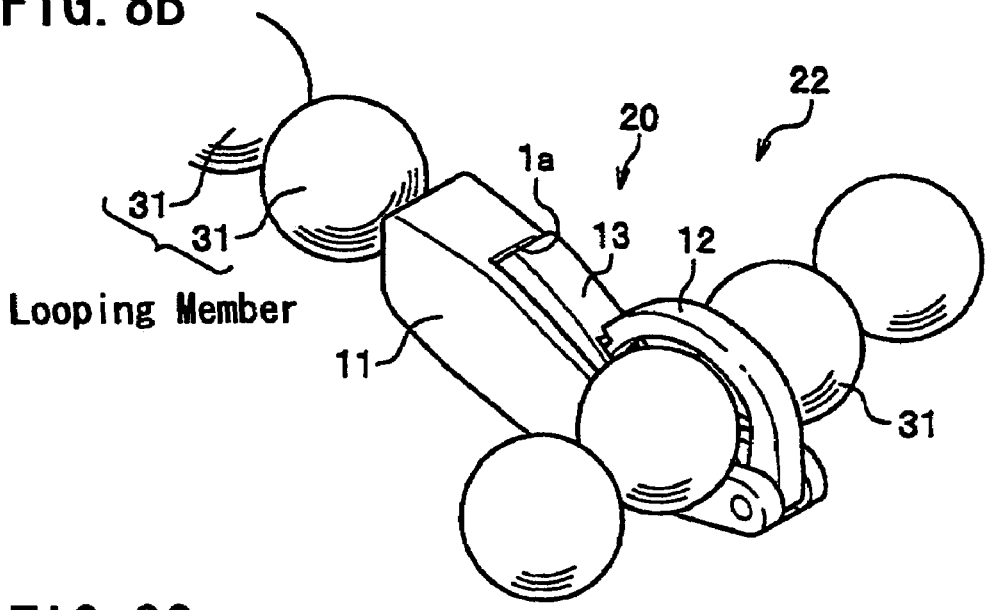
FIG. 8B is an enlarged drawing of portion A of FIG. 1B.
Figure 8C:
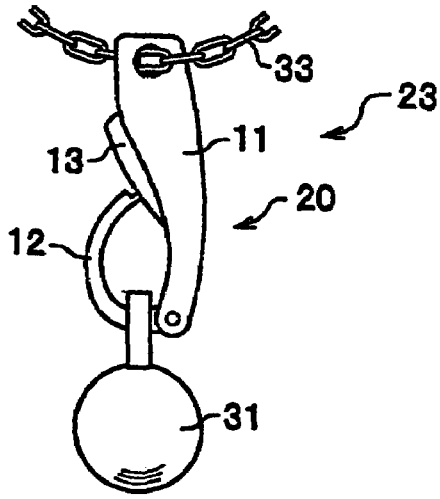
FIG. 8C is an enlarged drawing of portion A of FIG. 1C.

Next the second embodiment of the present invention will now be described. FIG. 8 shows a first embodiment of the present invention, wherein FIG. 8A is an enlarged drawing of portion A of FIG. 1A, FIG. 8B is an enlarged drawing of portion A of FIG. 1B, and FIG. 8C is an enlarged drawing of portion A of FIG. 1C. The second embodiment is an embodiment modified with the first embodiment, and the same parts are assigned to the same number and the repeated description will be omitted.

As shown in FIG. 8A in this necklace, a plurality of purls (31) are connected by a thread 32 to form a string member (series of purls), the claps 20 are connected to both ends of the thread 32, the thread 32 being is wound around a communication pin 1*e* formed at a rear side end of the base 1 to communicate the claps 10 with each other making up a loop of the necklace.

As shown in FIG. 8B, the necklace 21 comprises a thread 32, a clasp 20 connected to one end of the thread 32, and a pendant 22*a* (see FIG. 1B) connected to the other end of the thread 32. The clasp 20 is communicated between two purls of the series of the lined purls so as to arrange the optimum size of the loop.

As shown in FIG. 8C, the pendant 23 is composed of a chain 22 made of noble metal such as gold, platinum, and silver inserted into a hole provided on a rear end of the clasp 20, and a purl connected to the clasp 20.

Figure 9A:
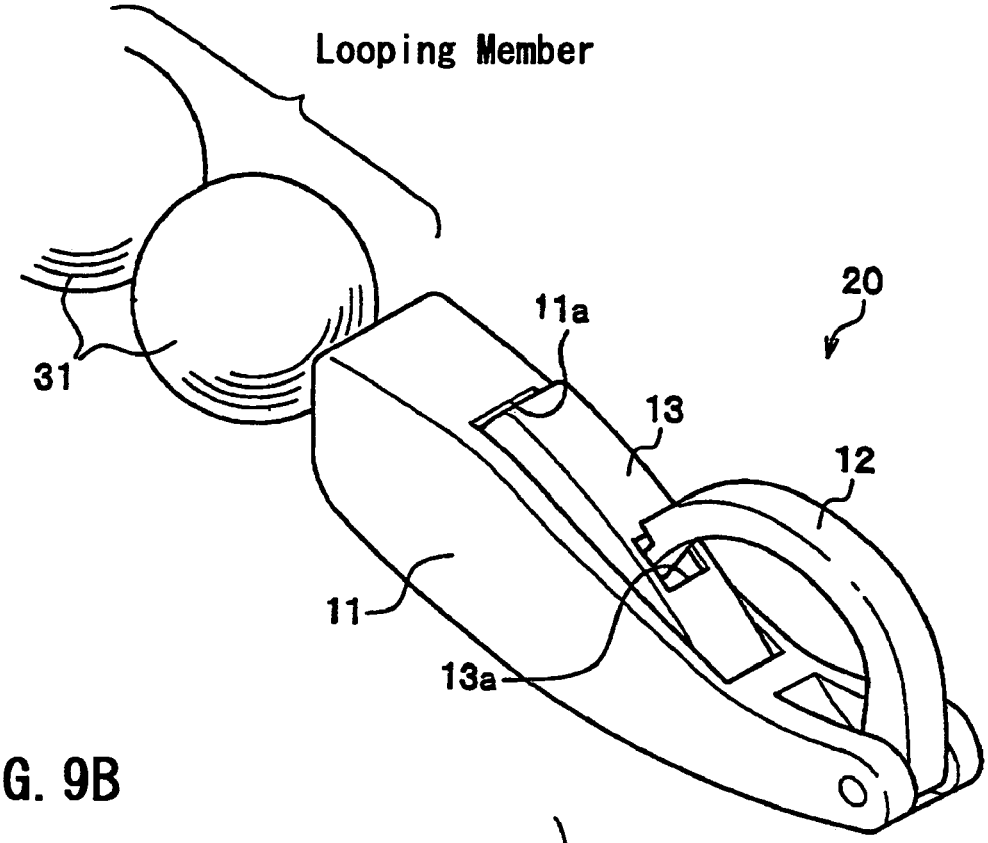
FIG. 9A is a perspective view and FIG. 9B is a perspective view showing the actuation of the arm.
Figure 9B:
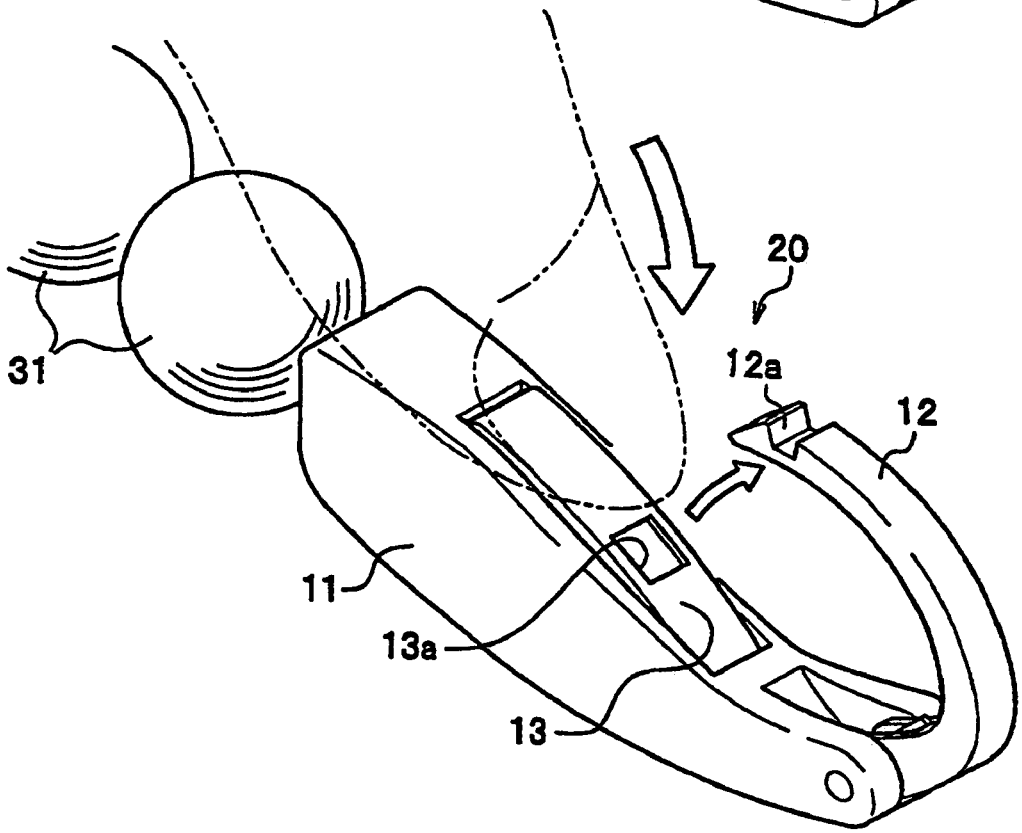

FIG. 9 shows a drawing enlarging the perspective view of FIG. 8, wherein FIG. 9A is a perspective view and FIG. 9B is a perspective view showing the actuation of the arm. As shown in FIG. 9, in the clasp 20 according to the second embodiment, a push button 13 is provided on the upper surface, and by pushing the push button 13, the nail portion 2*a* at the edge of the arm 12 is apart and the arm 12 is automatically released by the resilient force of the fourth spring.

Figure 10A:
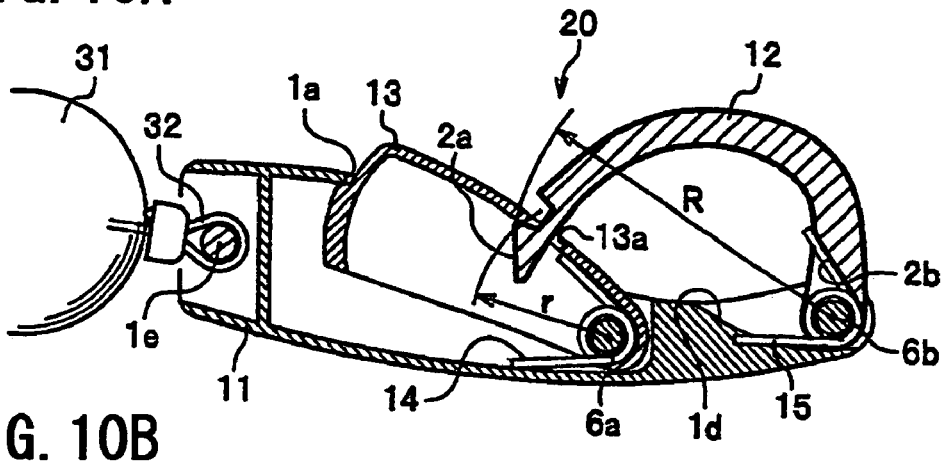
FIG. 10A shows a situation that the arm and the push button are communicated with each other.
Figure 10B:
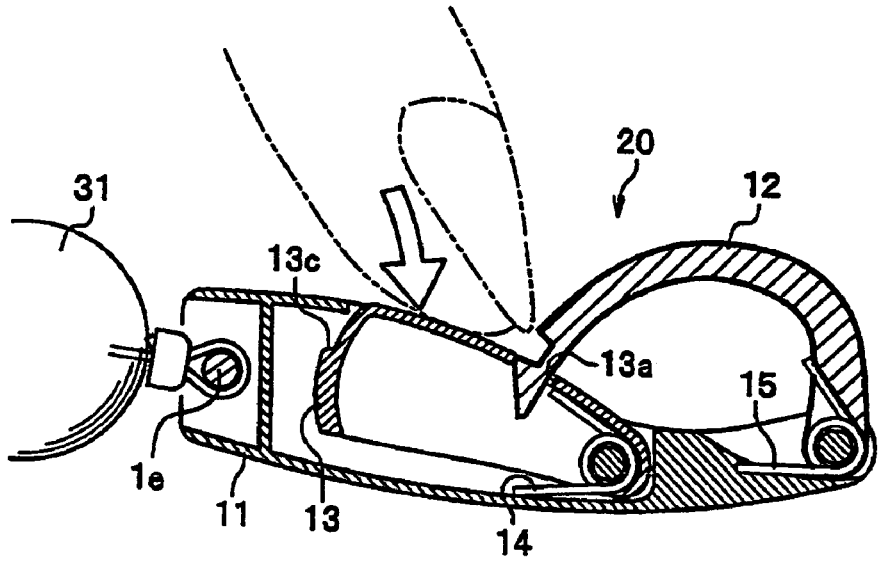
FIG. 10B shows a situation that the push button is pushed.
Figure 10C:
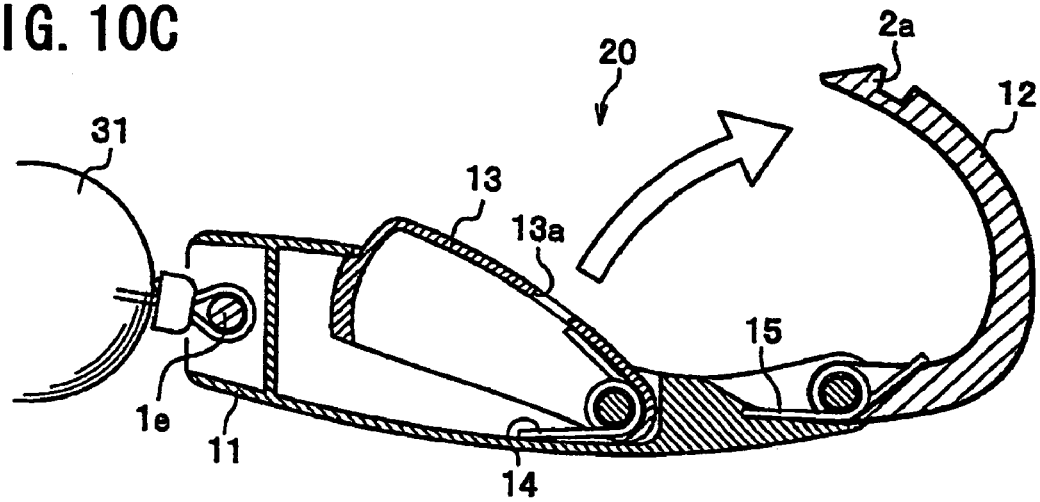
FIG. 10C shows a situation that the arm is apart from the communication part.
Figure 11A:
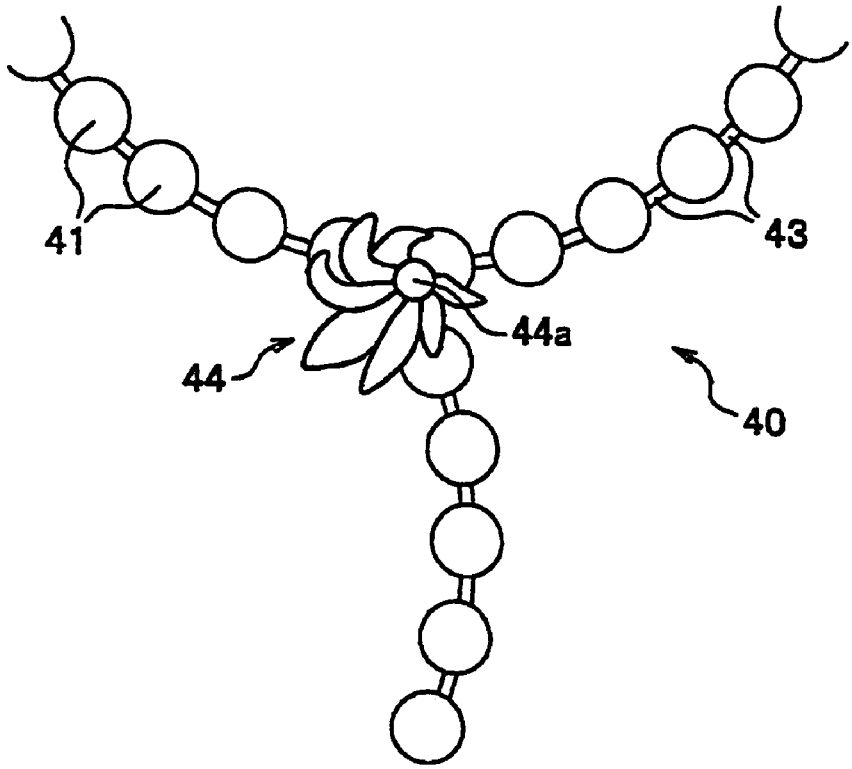
FIG. 11A (PRIOR ART)
FIG. 11 shows the conventional clasp wherein is a total view of the conventional clasp.
FIG. 11B is an enlarged perspective view showing a rear side of the connecting portion of the conventional clasp.
Figure 11B:
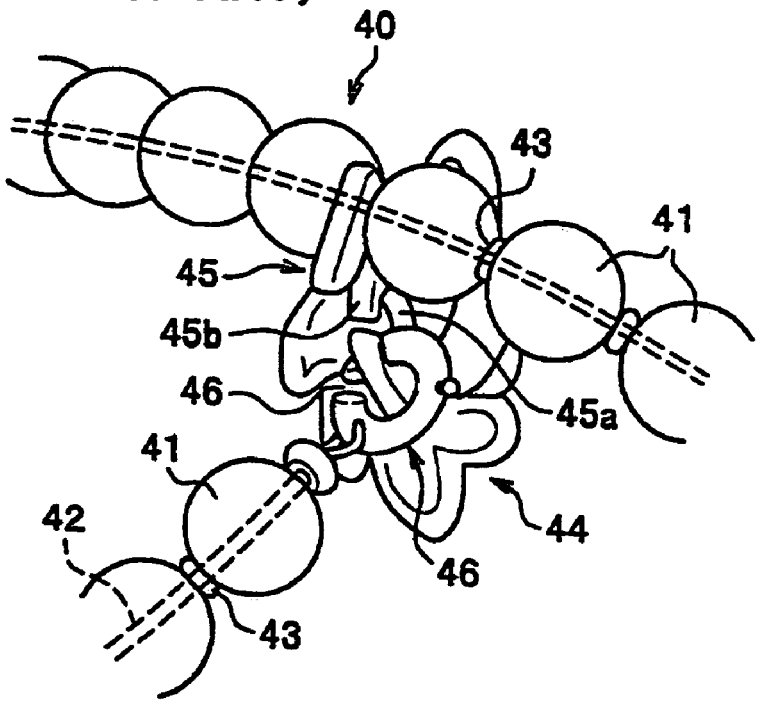
FIG. 11B (PRIOR ART)

FIG. 10 is a longitudinal sectional view of FIG. 9A, wherein FIG. 10A shows a situation that the arm and the push button are communicated with each other, FIG. 10B shows a situation that the push button is pushed, and FIG. 10C shows a situation that the arm is apart from the communication part. As shown in FIG. 10, the clasp 20 of the second embodiment is connected to a looping member comprising the a series of lined pearls 31, 31, . . . The thread 32 is wound around a communication pin 11*e* formed at a rear side end of the base 11 to connect the base 11 of the claps. An upper opening 1*a* is formed on the upper side of the base 11 of the clasp 20, and a push button 13 is projected on the upper opening 11*a*. The push button 13 is rotatably supported by a pin 6*a*.

Into inner circumferences of the base 11 and the push button 13 is inserted a torsion spring 14 serving as a third spring. To the push button 13 is always applied a resilient force in the direction that the push button is opened by the torsion spring 14, and as shown in FIG. 10B, a convex portion 13*c* is provided on one end of the push button 13 so that the push button is not projected any longer, and it is in contact with the base 11.

A communication hole 13*a* for communicating the nail portion 2*a* of the arm 12 is provided on an upper side of the push button 13. The communication hole 13*a* is of typically a rectangular shape, but it may have any other shape. By pushing the push button 13, the communication hole 13*a* is rotated around the pin 6*a* (radius r) . The communication hole 13*a* may be notched so that the position is slanted from the center.

The arm 12 is rotatably supported at the one end of the base 1 (right in this figure), and the other end of the arm 12 (left in this figure) has a nail portion 2*a*. The base 11 and the arm 12 make up a ring by closing the arm 12. The base 11 and the arm 12 are supported in a rotatable manner by means of a pin 6*b*.

Groove portions 11*d* and 12*b* are formed within the inner circumferences of the base 11 and the arm 12, respectively, and a torsion spring 15 which is the fourth spring is fitted to these groove portions 11*d* and 12*b*. The push button 13 to which the resilient force is always applied in the direction of opening the push button 13 is pushed to thereby rotate nail portion 12*a* of the arm 12 around the pin 6*b* taking "r" as radius. The radius "r" and the locus of the radius "r" are crossing with each other and, thus, by pushing the push button 13, the radius "r" is coming out of the locus of the radius "r". Consequently, the nail portion 12*a* of the arm 12 is coming out of the communication hole 13*a*, and the arm 12 is automatically released by means of the resilient force of the fourth spring.

Next, the operation of the clasp 20 will now be described by referring to FIG. 10.

As shown in FIG. 10A, in the clasp 20 of the present invention in the fastened state, the nail portion 12*a* of the arm 12 is tightly communicated with the communication portion 13*c* of the push button 13.

As shown in FIG. 10B, once the push button 13 is slightly pushed, the arm 13 is rotated with the locus of the radius r and the communication between the arm 12 and the communication hole 13*a* of the push button is released. As a conquest, as shown in FIG. 10C, the arm 12 is automatically released by means of the resilient force of the fourth spring.

As described above, the clasp according to this embodiment can be operated only by one hand, there is no fear for injuring nail for example of woman, and the clasp according to the present invention can be easily handled for example by aged person.

While the embodiments of the present invention have been described, the present invention is not restricted thereto, and various modification can be made without departing from the sprits and the scope of the present invention. Typical modifications are as follows:

(1) The looping member is not restricted to that composed of beads, and various looping members may be applied.

(2) While the arrangement of the accessories is described mainly utilizing a necklace. The same is applicable to bracelet, anklet, pendant, and any other accessories.

(3) In FIG. 5, while the front side opening 1*b* is provided on the front side of the base 1, alternatively, an opening may be provided on the flank side of the base 1 (side opening).

(4) Instead of the cavity 3*d* provided on the backside opening 3*b* of the push button 3, a hole through which the first spring is pierced may be formed.

(5) The third spring 13 provided between the inner circumferences of the base 11 and the push button 13 may be a coil spring or any other spring.

(6) As shown in FIG. 4, FIG. 5, FIG. 8, and FIG. 10, around the communication pin 1*e* of the base is directly wound the thread 32, but the thread 32 and the base 1 may be connected via a circular ring.

What is claimed is:

1. A clasp which comprises:

a base connected to at least one end of looping member, the base having an upper opening at an upper side thereof and which has a front opening at a front side thereof;

an arm which is supported by the edge of said base in a rotatable manner, which has a nail portion at a rear end thereof, and which makes up a loop by closing the arm;

a push button embedded within the upper opening of the base and communicated with said nail portion of the arm;

a first spring which applies a resilient force to said push button in the direction that the push button is projecting outwardly; and a second spring which applies a resilient force to said arm in the direction of opening the arm.

2. The clasp according to claim 1, wherein a cavity is provided on an inner surface of the base at a portion overlooking from the front opening.

3. The clasp according to claim 1, wherein said first spring comprises a coil spring and said second spring is a torsion spring.

4. The clasp according to claim 1, wherein said push button has an upper opening provided at an upper side thereof, a back side opening provided at the back side thereof, and a step provided at a front side thereof, and one side of the upper opening is making up a communicating portion.

5. The clasp according to claim 4, which is assembled by (a) a step for inserting the first spring into the push button from the back side opening thereof;

(b) a step for inserting the push button having the first spring inserted therein into the base from the upper opening thereof allowing one end of the first spring for falling into the cavity of the base to thereby cover the front side opening of the base with the push button in the state of applying the resilient force of the first spring to the front opening; and (c) a step for inserting a pin which is connected to the edge of the base into one end of the arm via the second spring to support the arm by the base in a rotable manner.

6. An accessory having the clasp according to claim 1.

7. The accessory according to claim 6, which is necklace, bracelet, anklet, or pendant.

* * * * *